United States Patent [19]

Salomon

[11] 4,290,213

[45] Sep. 22, 1981

[54] SKI-BOOT ENABLING ITS DELIBERATE RELEASE FROM THE SKI BY MEANS OF THE SKI-STICK

[75] Inventor: Georges P. J. Salomon, Annecy, France

[73] Assignee: Etablissements Francois Salomon et Fils, Annecy, France

[21] Appl. No.: 970,963

[22] Filed: Dec. 19, 1978

[30] Foreign Application Priority Data

Dec. 23, 1977 [FR] France ..... 77 39072

[51] Int. Cl.[3] ..... A43B 5/04; A63C 9/00

[52] U.S. Cl. ..... 36/117; 280/614; 280/617

[58] Field of Search ..... 36/117, 118, 119, 120, 36/121; 280/11.35 T, 11.35 K, 11.35 Y

[56] References Cited

U.S. PATENT DOCUMENTS 3,908,971 9/1975 Engel ..... 280/614

FOREIGN PATENT DOCUMENTS 1908158 2/1965 Fed. Rep. of Germany ... 280/11.35 K 1480975 5/1965 France ..... 280/11.35 K 1562028 4/1969 France ..... 280/11.35 K 2020728 10/1969 France ..... 280/11.35 K 2045480 2/1971 France ..... 36/117

*Primary Examiner*—Patrick D. Lawson

*Attorney, Agent, or Firm*—Sandler & Greenblum

[57] ABSTRACT

The present invention relates to a ski-boot more particularly designed to enable deliberate release of a ski-boot from a ski by means of a ski-stick.

The ski-boot comprises bearing-surfaces and retention means especially comprising a hole 18 adapted to cooperate with the ski-boot from the ski and in order on the other hand to avoid its slipping during the release of the ski-boot from the ski.

The boot in accordance with the invention offers the advantage of facilitating the deliberate release of the fastening between the ski-boot and the ski.

17 Claims, 10 Drawing Figures

SKI-BOOT ENABLING ITS DELIBERATE RELEASE FROM THE SKI BY MEANS OF THE SKI-STICK

The present invention relates to a ski-boot component which enables deliberate release of the ski-boot with respect to the ski by means of the ski-pole.

At present in order deliberately to release his attachment to the ski the skier actuates a release lever. In order not to have to exert too great a force on this lever it generally acts by reduction or by way of a mechanical device upon the locking system.

This kind of arrangement displays certain disadvantages. In short, the construction of such devices is complicated, which brings about a high cost of manufacture and doubtful reliability.

Hence the present invention proposes an arrangement which is particularly simple and reliable.

In short it proposes a boot component characterized in that it comprises bearing-surfaces adapted to cooperate with the lower portion of a ski-pole which itself bears at its end against a bearer member integral with the ski so as to permit deliberate release of the ski-boot from the ski and means of retention for retaining the pole in order to avoid its slipping during the course of the release of the ski-boot from the ski. The bearing surfaces move together with the ski-boot, and are therefore stationary relative thereto, as pressure is exerted by the lower portion of the ski-pole.

With such an arrangement, for the deliberate release of the ski-boot from the ski it is sufficient to get a bearing against the ski and to actuate the ski pole which acts as a lever to force the ski-boot to release against the action of the locking system. This is of particular interest because the force which the skier must exert is very low this being due to the fact that the ski-pole provides great leverage.

The system is also of particular interest because by forcing the ski-boot to via the release position the skier is this phrase verifying that his release is properly operating.

In accordance with the invention, the pole, in order to form a lever, gets a bearing against the ski and either against the boot or against a piece connected to the boot such in particular as a release plate.

In order to avoid slipping of the ski stick during the course of releasing the ski-boot from the ski, the boot or the boot component comprises bearing surfaces for the ski-pole and means of retention for it.

The bearing surfaces and the means of retention advantageously comprise a hole. The hole may if necessary be partially open.

One of the advantages of the hole is that the ski-pole becomes captive and cannot break away. Advantageously the deliberate release of the ski-boot from the ski will be done by trigger action or twisting, because one has a lower energy to combat than on the vertical. The hole is located at the front of the foot for several reasons: in order that the skier can easily plant his ski-pole without having to turn round and in order that the ring of the ski-stick does not interfere with the manoeuvre since by using this technique it assumes a position above the top of the front of the foot (see FIGS. 1 and 2).

Figure 4:
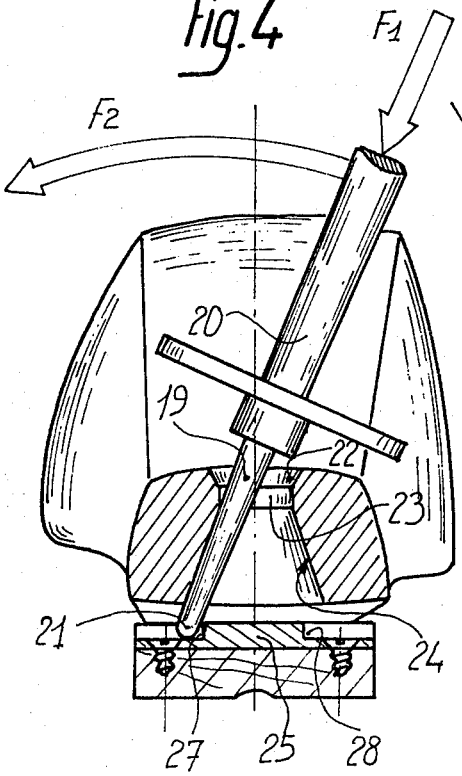
FIG. 4 is a representation on a large scale and before release of the ski-boot from the ski, along the cross-section AA in FIG. 3.
Figure 5:
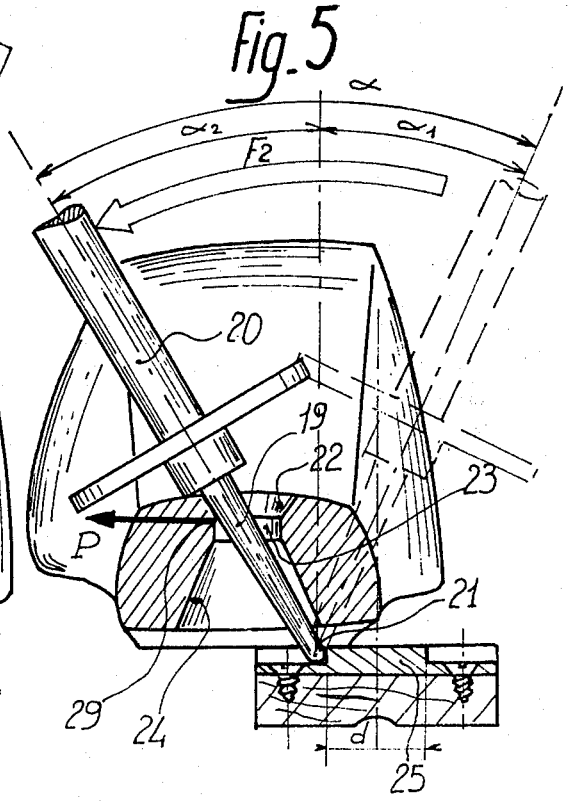
FIG. 5 is an identical representation but during the course of a deliberate release of the ski-boot from the ski.
Figure 6:
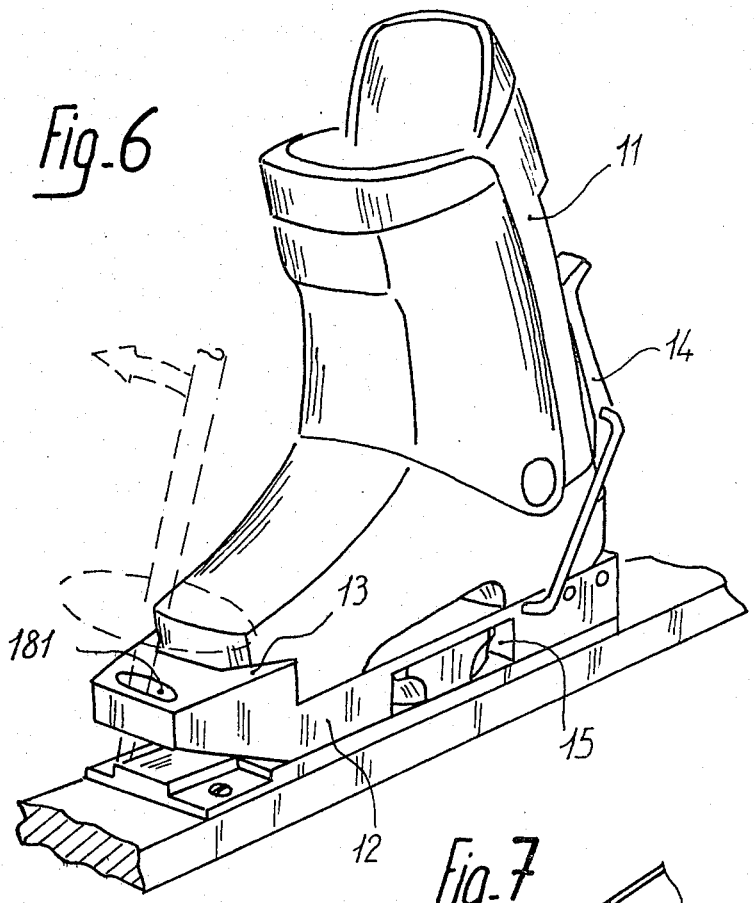
FIG. 6 is a representation in perspective of another embodiment, in which a conventional boot is equipped with a release plate.

FIGS. 1-2-3-4-5 and 10 illustrate a boot known as an "attachment boot" whilst the embodiment in FIG. 6 represents a conventional boot rendered temporarily integral with a plate for the purpose of skiing. In both of these embodiments a block 3 integral with the ski is arranged in a recess 16 in the sole (embodiment FIGS. 1-2-3) or a recess 15 in the plate. The recess 15 (and 16) lies in a zone located under the foot of the skier and is open to the side.

This kind of device furthermore forms the object of the French patent application No. 76.26686 made by the Applicants. We may remark only that the block 3 attached to the ski comprises along the longitudinal axis of the ski a hollow profile 7 at the front, another hollow profile 8 at the rear and a substantially vertical oblong hole located substantially in the centre of the block between the two hollow profiles.

In the example of FIG. 6 for the purpose of skiing the boot 11 is held on to the plate 12 by virtue of a front retention member 13 and a rear retention member 14.

The sole 17 of the boot 1 (and the plate 12 of the boot 11) comprises a fixed portion 4 which projects into the hollow 16 to cooperate with the front hollow profile 7 and a movable portion 6 which also projects into the hollow 16 and cooperates with the rear hollow profile 8. Advantageously a a projecting pivot 5 integral with the boot cooperates with the oblong hole 9. An elastic device 10 is provided against which the release will be effected. Advantageously the hole 18 in the boot is at the front and of elongated shape transversely and its width is slightly greater than the dimension of the bottom portion 19 of the ski-pole 20. The hole 18 comprises a tapered upper portion 22 in the form of a funnel which widens upwardly. This tapered portion is to facilitate the introduction of the ski-pole. The hole widens towards the bottom to form a tapered portion 24.

Figure 7:
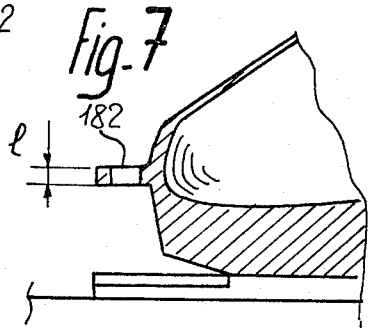
FIG. 7 is a partial view identical with FIG. 3 showing another embodiment in accordance with the invention.
Figure 8:
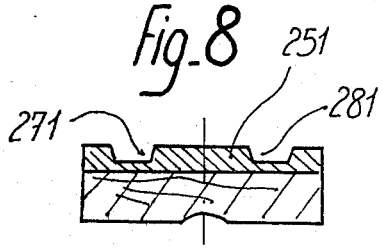
FIG. 8 shows in cross-section another embodiment of the bearer-piece.
Figure 9:
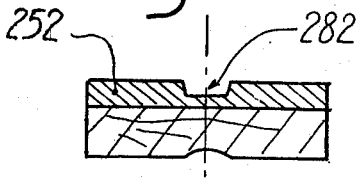
FIG. 9 shows in cross-section a variant upon the bearer-piece.

In the above embodiment tapered portion 24 widens towards the bottom in order to allow angular clearance for the ski-stick (FIGS. 4 and 5) because the hole has a certain length. This is only an advantageous embodiment and the hole may also have the shape represented in FIG. 7, i.e., purely and simply cylindrical and of short length "1". A bearing element 25 is attached to the ski, for example, by two screws 26 and comprises two bearing corners 27 and 28 arranged on opposite sides of the longitudinal plane of symmetry of the ski, these two bearing corners being arranged at a certain distance from one another. This is only an preferred arrangement and it might be varied e.g., as in FIGS. 8 and 9. The embodiment of the bearing element 251 in FIG. 8 comprises two lateral bearing seatings 271 and 281, whilst FIG. 9 comprises a single bearer seating 282 positioned on the axis of the ski.

It is particularly advantageous to laterally offset the point of application of the ski-pole against the ski. That is, inasmuch as for release of the ski-boot from the ski a movement of rotation must be imparted to the ski-pole with respect to the tip 21, it is preferable to have an initial angular position (FIG. 4) slightly inclined towards the side opposite from the movement in order that at the end of travel the final angular position is not too exaggerated. As is shown in FIGS. 4 and 5, the release of the ski-boot from the ski will be achieved after an angular movement $\alpha$ and the initial position of the ski pole is inclined at an angle $\alpha_1$ in the direction opposite to the movement. For this reason $\alpha_2=\alpha-\alpha_1$. If $\alpha_1$ had been equal to 0, that is, if the initial position of the ski-pole had been vertical, the final position would have been inclined by $\alpha$. In the embodiment $\alpha_2$ which $=\alpha-$ of the invention $\alpha_1$ hence is less than $\alpha$. In sum, the angle $\alpha$ has been distributed on opposite sides of the vertical, which is particularly advantageous because in this way the skier does not have to lean too much in order to succeed in releasing the ski-boot from the ski.

Figure 1:
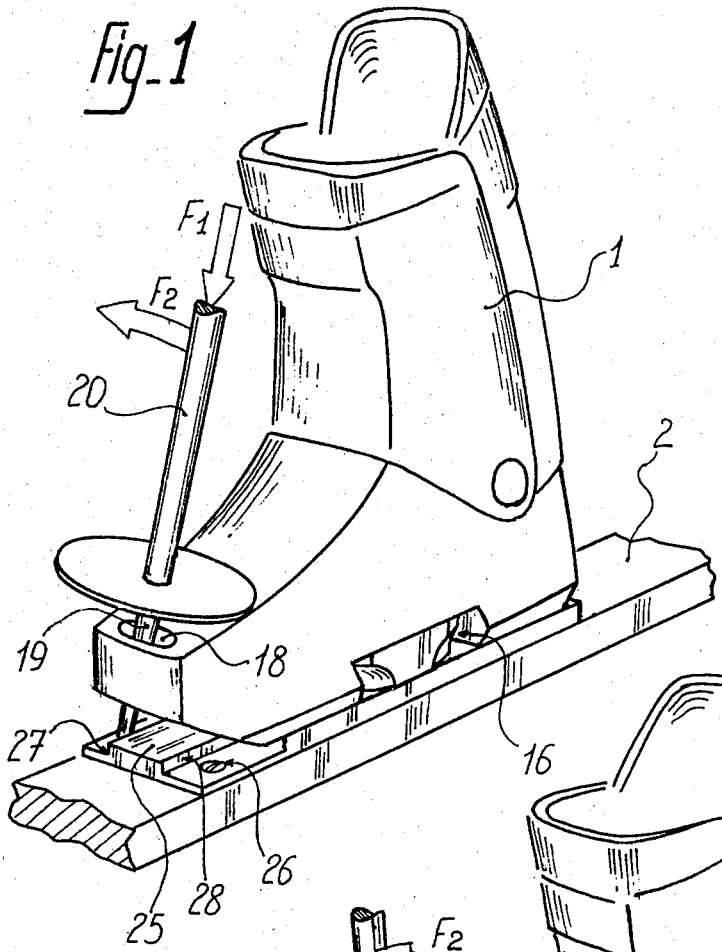
FIG. 1 represents in perspective a ski-boot attachment in accordance with the invention prior to deliberate release of the ski-boot from the ski.
Figure 2:
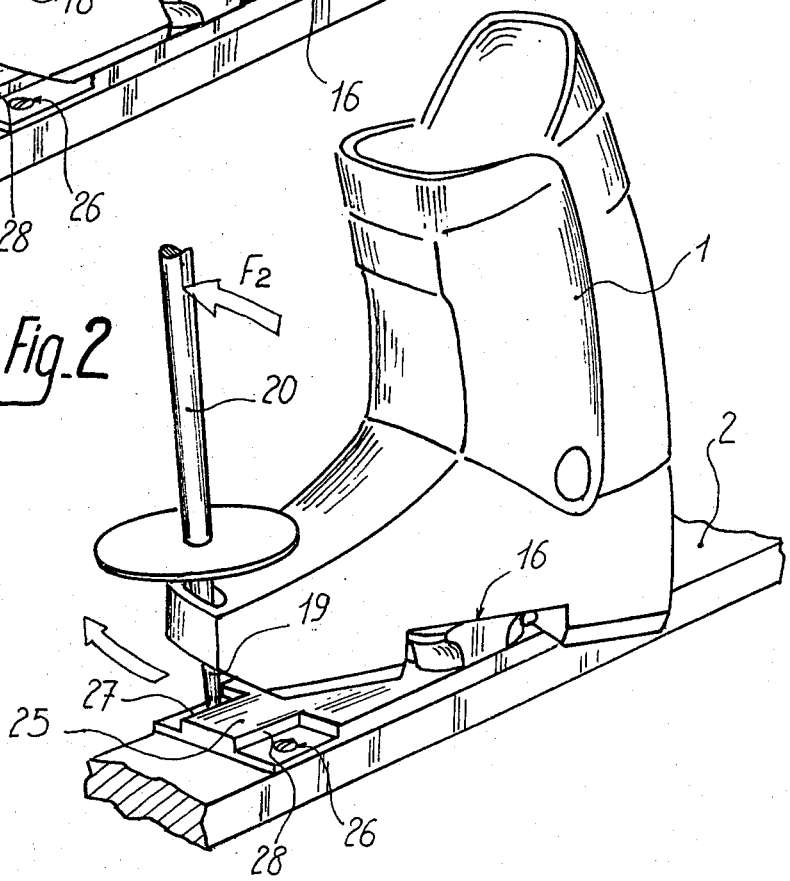
FIG. 2 represents in perspective the same ski-boot attachment in accordance with the invention during the course of a deliberate release of the ski-boot from the ski.
Figure 3:
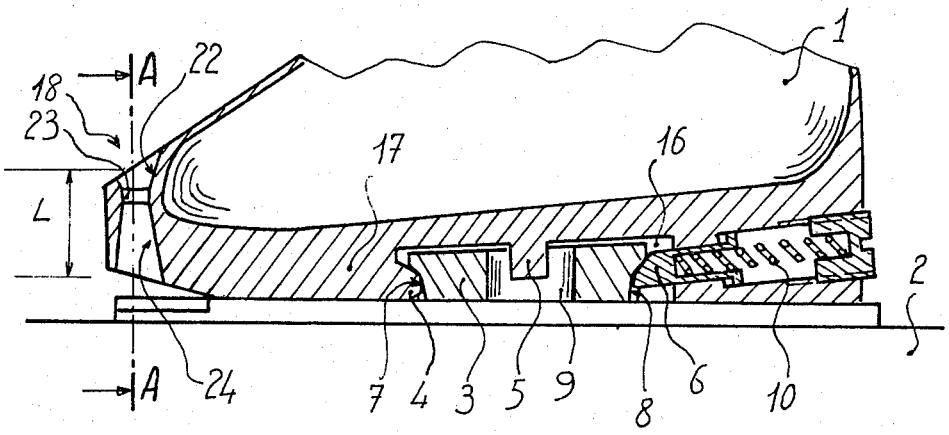
FIG. 3 represents the device as FIG. 1, but in section along an axial plane perpendicular to the ski (only the ski-boot and the block are in section).

Thus, in order to release the ski-boot from the ski it is sufficient to place the tip of the ski-stick 19 along the direction $F_1$ into the hole 18 in the boot, thus arranging the tip 21 to bear against the bearing element (FIGS. 1 and 4). By imparting a movement of angular rotation to the ski-pole as indicated by the arrow $F_2$ (FIGS. 2 and 5) one thus creates at the point of contact 29 between the boot and the ski-pole a force having a horizontal component P (FIG. 5) which urges and forces the boot in rotation until release. In the embodiment described the rotation of the boot is effected around pivot 5.

Figure 10:
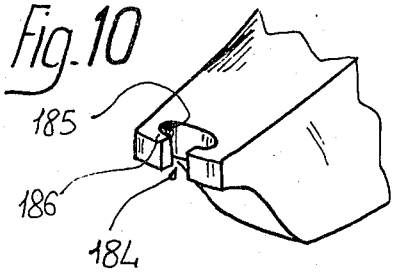
FIG. 10 is a representation in perspective of the front of a boot showing an alternative embodiment.

FIG. 10 represents a front perspective of a boot having a hole of an alternative embodiment. In this embodiment the hole is partially open towards the front at 184. For the release of the ski-boot from the ski by twisting towards the right, for example, the ski-pole will take a bearing at 185 in order to form a lever and the front portion 186 will prevent the ski-pole from slipping forwards during the course of the release of the ski-boot from the ski.

FIG. 6 shows yet another embodiment of the invention where the hole 181 is arranged in a member such as a plate associated with the boot for the purpose of skiing.

It would not depart from the scope of the invention if one had a conventional fitting of the type with the stop more at the heel.

It should be further noted that the hole may also be located at the rear of the boot behind the heel.

In the embodiments proposed the hole is located on the longitudinal axis and the deliberate release of the ski-boot from the ski may be effected to the right or to the left. However, this may be done alternatively by arranging the hole either at one side of the axis or the other or there might even be two holes arranged on opposite sides of the axis.

As shown the bearing against the ski is effected by virtue of an element integral with the ski. However, this need not be the case and one might, if desired, bear directly against the ski and especially against the side edge of the ski as an alternative means of obtaining the same leverage.

What is claimed is:

1. A ski-boot adapted to be releasably engaged on a ski, said ski-boot comprising one bearing surface adapted to cooperate with a lower portion of a ski-pole whereby deliberate movement of said ski-pole relative to said ski while said lower portion of said ski-pole bears against said bearing surface causes said ski-boot to be released from said ski, said ski boot further comprising retention means for retaining the lower portion of said ski-pole in cooperation with said bearing surface during said deliberate motion of said ski-pole, wherein said bearing surface and said retention means comprise a single hole.

2. A ski-boot adapted to be releasably engaged on a ski, said ski-boot comprising at least one bearing surface, said bearing surface being adapted to cooperate with a lower portion of a ski-pole and being further adapted to remain stationary relative to said ski-boot whereby deliberate movement of said ski-pole relative to said ski while said lower portion of said ski-pole bears against said bearing surface causes said ski-boot to be released from said ski, said ski-boot further comprising retention means for retaining the lower portion of said ski-pole in cooperation with said bearing surface during said deliberate motion of said ski-pole.

3. The ski-boot as defined by claim 2 wherein said bearing surface and said retention means comprise a single hole.

4. The ski-boot as defined by claim 1 or 3, wherein said hole is partially open along its circumference.

5. The ski-boot as defined by claims 1 or 3 wherein said hole has a substantially vertical axis.

6. The ski-boot as defined by claim 5 wherein said hole is oblong and the major axis of said hole is transverse to the longitudinal axis of said boot.

7. The ski-boot as defined by claim 1 or 3 whereby said retention means is arranged such that said ski-pole exerts a lever action on said ski-boot relative to said ski as said ski-pole is moved relative to said ski so as to release said boot from said engagement with said ski.

8. The ski-boot as defined by claim 7 wherein said hole is integral with said ski-boot.

9. The ski-boot as defined by claim 8 wherein said hole extends from an upper surface to a lower surface on said ski-boot and the cross-section of the upper portion of said hole tapers so as to facilitate insertion of said lower portion of said ski-pole into said hole.

10. The ski-boot as defined by claim 8 wherein the lower portion of said hole is tapered so as to facilitate deflection of said ski-pole when inserted within said hole.

11. The ski-boot as defined by claim 7 said hole is arranged in a member distinct from but at least temporarily integral with said ski-boot.

12. The ski-boot as defined in claim 11 wherein said hole extends from an upper surface to a lower surface on said ski-boot and the cross-section of the upper portion of said hole tapers so as to facilitate insertion of said lower portion of said ski-pole into said hole.

13. The ski-boot as defined by claim 11 wherein the lower portion of said hole is tapered so as to facilitate deflection of said ski-pole when inserted within said hole.

14. The ski-boot as defined by claim 1 or 2 wherein said ski-boot is adapted to be releasably engaged to said ski whereby said ski-boot is released by rotation and lateral disengagement of said ski-boot.

15. The ski-boot as defined by claim 11 wherein said ski-boot and said member are adapted to be secured to said ski whereby said ski-boot and said member are released from said ski by rotation and lateral disengagement of said ski-boot.

16. The ski-boot as defined by claim 1 or 2 in combination with a seating adapted to be arranged along the longitudinal axis of said ski-boot when said ski-boot is releasably engaged on said ski, said seating being adapted to receive the lower portion of said ski-pole.

17. The ski-boot as defined by claim 1 or 2 in combination with at least one seating adapted to be mounted on said ski so as to be offset with respect to the longitudinal axis of said ski-boot when said ski-boot is releasably engaged on said ski.

* * * * *

UNITED STATES PATENT AND TRADEMARK OFFICE

CERTIFICATE OF CORRECTION

PATENT NO. : 4,290,213

DATED : September 22, 1981

INVENTOR(S) : Georges Pierre Joseph SALOMON

It is certified that error appears in the above—identified patent and that said Letters Patent is hereby corrected as shown below:

Column 1, line 41, "this phrase" should be --at the same time--;

lines 62-63, "manoeuvre" should be --maneuver--.

Column 2, line 50, "a" (second occurrence) should be deleted;

line 58, "is to facilitate" should be --facilitates--.

Column 3, lines 25-26, "$\alpha_2$ which = $\alpha$ - of the invention $\alpha$, hence" should be --of the invention $\alpha_2 = \alpha - \alpha_1$, which--;

line 67, --,-- should be inserted after "shown".

Signed and Sealed this

*Twenty-second* Day of *December 1981*

[SEAL]

*Attest:*

GERALD J. MOSSINGHOFF

*Attesting Officer*

*Commissioner of Patents and Trademarks*